US008893723B2

(12) United States Patent
Jahnke et al.

(10) Patent No.: US 8,893,723 B2
(45) Date of Patent: Nov. 25, 2014

(54) METHOD AND DEVICE FOR REMOVING FOREIGN PARTICLES FROM A TOBACCO STREAM

(75) Inventors: Matthias Jahnke, Hamburg (DE); Harry Drewes, Hamburg (DE); Torsten Grigutsch, Hamburg (DE); Hans Dierken, Amelinghausen (DE); David Felts, Knoxville, TX (US); Jeroen Erinkveld, TD Nijmegen (NL); Diederick van Klaarbergen, ED Ochten (NL)

(73) Assignee: Hauni Maschinenbau AG, Hamburg (DE)

( * ) Notice: Subject to any disclaimer, the term of this patent is extended or adjusted under 35 U.S.C. 154(b) by 1197 days.

(21) Appl. No.: 12/683,675

(22) Filed: Jan. 7, 2010

(65) Prior Publication Data

US 2011/0162666 A1 Jul. 7, 2011

(51) Int. Cl.
*A24B 1/02* (2006.01)
*A24B 1/04* (2006.01)

(52) U.S. Cl.
CPC ..... *A24B 1/04* (2013.01)
USPC ..... 131/109.2; 209/539; 209/552; 209/639; 209/644; 209/44.2

(58) Field of Classification Search
CPC ..... A24B 1/04
USPC ..... 131/109.2, 904, 905, 906, 909; 209/539, 552, 639, 644, 44.2
See application file for complete search history.

(56) References Cited

U.S. PATENT DOCUMENTS

| | | | | |
|---|---|---|---|---|
| 7,335,847 | B2 * | 2/2008 | Drewes et al. | 209/587 |
| 7,448,391 | B2 | 11/2008 | Funke et al. | |
| 2005/0211257 | A1 | 9/2005 | Funke et al. | |
| 2005/0224396 | A1 | 10/2005 | Schroder | |
| 2005/0236306 | A1 | 10/2005 | Drewes et al. | |
| 2008/0087583 | A1 | 4/2008 | Van de Laak et al. | |
| 2011/0067714 | A1 * | 3/2011 | Drewes et al. | 131/282 |

FOREIGN PATENT DOCUMENTS

| | | |
|---|---|---|
| DE | 10 2004 015 463 | 10/2005 |
| DE | 102004015463 | 10/2005 |
| EP | 1 576 897 | 9/2005 |
| EP | 1584380 | 10/2005 |
| EP | 1591172 | 11/2005 |
| EP | 1 838 464 | 10/2007 |
| EP | 1838464 | 10/2007 |

OTHER PUBLICATIONS

Search report from International Bureau of WIPO that issued with respect to patent family member International Patent Application No. PCT/EP2011/000001, mail date is Jul. 7, 2011.

* cited by examiner

*Primary Examiner* — Richard Crispino
*Assistant Examiner* — Dionne Walls Mayes
(74) *Attorney, Agent, or Firm* — Greenblum & Bernstein, P.L.C.

(57) ABSTRACT

Method and device for removing foreign bodies from a first tobacco stream that is conveyed via an air flow in a region of a first foreign body detection device. Method includes detecting, with a first foreign body detection device, the foreign bodies in the first tobacco stream based on at least one property, and removing, with a jet of compressed air, the foreign bodies from the first tobacco stream. In this manner, a foreign body freed tobacco stream and a second tobacco stream including tobacco particles and the foreign bodies entrained by the jet of compressed air are formed. Method also includes at least one of: accelerating the second stream at a distance from the first tobacco stream; and detecting, with a second foreign body detector, foreign bodies in the second stream based on at least one property and removing the detected foreign bodies with a second jet of compressed air.

11 Claims, 3 Drawing Sheets

METHOD AND DEVICE FOR REMOVING FOREIGN PARTICLES FROM A TOBACCO STREAM

BACKGROUND OF THE INVENTION

1. Field of the Invention

The invention relates to a method for removing foreign bodies from a first tobacco stream, wherein the first tobacco stream is conveyed in the region of a first foreign body detection device with an air flow, and wherein foreign bodies in the first tobacco stream are detected based on at least one property by means of the first foreign body detection device and subsequently removed from the first tobacco stream by a jet of compressed air, so that the first tobacco stream freed from foreign bodies and a second stream of tobacco particles and foreign bodies entrained by the jet of compressed air are formed.

2. Discussion of Background Information

The invention further relates to a device for removing foreign bodies from a first tobacco stream with a device (feed device) feeding the first tobacco stream to a first foreign body detection device and a first foreign body ejection device downstream of the first foreign body detection device, wherein the feed device for conveying the first tobacco stream has a compressed air source, and wherein the first foreign body ejection device has a first nozzle device, by means of which foreign bodies can be removed from the first tobacco stream with compressed air, whereby a second stream of foreign bodies and tobacco particles entrained by the compressed air is formed.

A method for removing foreign bodies from a tobacco stream and a corresponding device are known, e.g., from DE 10 2004 015 463 B4. Through this method and this device it is known how to examine a tobacco stream for foreign bodies with a high tobacco throughput and to separate foreign bodies accordingly.

The property that is used to detect the foreign body in the tobacco stream can hereby be in particular and also in the scope of the invention an optical property of the tobacco or the foreign body, such as the brightness, shape and/or color or another physical property such as the moisture, the specific weight or the presence of corresponding elements (carbon or metals).

The foreign body detection is carried out preferably by means of recording the brightness and/or color of the objects contained in the tobacco stream. In this context, objects in particular refers to tobacco, tobacco leaves, cut tobacco and foreign bodies. The conveyor speed of the tobacco stream according to DE 10 2004 015 463 B4 as well as according to the invention is between 6 m/s and 30 m/s, in particular between 17 m/s and 30 m/s. The preferred speed means that a very effective conveyance of the tobacco stream is provided, whereby a very high throughput is rendered possible. In particular, the embodiments according to DE 10 2004 015 463 B4 with respect to the drawing apart of the tobacco stream transversely to the conveying direction in the one direction and the tapering of the tobacco stream crosswise to the conveying direction and in the other direction, which is also transverse to the one direction, are also provided.

From EP 1 838 464 B1 a method and a device are known for sorting a stream of in general flat and lightweight articles of different dimensions, wherein the articles to be removed are drawn out from the main stream with suction air by means of suction action through a vacuum.

From EP 1 576 897 B1 a device and a method are known for scanning and sorting tobacco leaves, wherein a rejection device is provided which reacts to a rejection signal and is configured to force unacceptable tobacco leaves and undesirable particles from the conveyor duct.

The devices and the method according to the prior art all have the disadvantage that after the removal of the foreign bodies, the tobacco leaves that have been removed with them but are actually good or acceptable are removed in relatively large quantity, so that a relatively large loss of tobacco is incurred. This necessitates a resorting, which in the prior art is carried out on conveyor belts in an optical method. This leads to a very high expenditure in terms of equipment and nevertheless to suboptimal results.

SUMMARY OF THE INVENTION

The present invention renders possible an improved quota of removed foreign bodies to tobacco particles.

Accordingly, the invention is directed to a method for removing foreign bodies from a first tobacco stream, wherein the first tobacco stream is conveyed with an air flow in the region of a first foreign body detection device, and wherein foreign bodies in the first tobacco stream are detected by means of the first foreign body detection device based on at least one property and subsequently removed from the first tobacco stream by a jet of compressed air so that the first tobacco stream freed from foreign bodies and a second stream of tobacco particles and foreign bodies entrained by the jet of compressed air are formed, which is further developed in that the second stream is accelerated at a distance from the first tobacco stream and/or in that foreign bodies are detected again in the second stream by a second foreign body detection device based on at least one property and subsequently removed by a jet of compressed air.

Within the scope of the invention, foreign bodies also includes tobacco material that is unacceptable for further processing. This means, for example, tobacco ribs that are too large.

The invention has adopted the idea that in the prior art with respect to the discharged stream of foreign bodies and entrained tobacco particles, which would be suitable per se for further processing, thought was given which on the one hand ensures an efficient discharge and on the other hand ensures a further efficient separation of the foreign bodies with a high sorting rate or high conveyor rate.

The first idea according to the invention, namely to accelerate the second stream at a distance from the first tobacco stream, is used in particular to prevent lighter foreign bodies such as feathers from being drawn back into the first tobacco stream by eddies. An efficient evacuation of all of the particles removed by the pressure surge, namely corresponding foreign bodies as well as entrained tobacco particles, is rendered possible through the acceleration in the evacuation channel. The further idea according to the invention, namely to provide a second foreign body detection device which again detects foreign bodies based on at least one property in the second stream and subsequently removes them with a jet of compressed air, ensures that in the end a particle stream is obtained that essentially is composed only of tobacco that can be efficiently used again and can be returned to the circulation. Since all of this takes place in an air flow system, a very efficient, compact plant or device can be realized, which efficiently renders possible a removal of foreign bodies from a tobacco stream with a very high throughput.

With a tobacco stream quantity to be screened or separated from foreign bodies of approx. 1 t/h to 10 t/h, for example, 1% of tobacco that is still good per se has been hitherto removed by the foreign body removal. According to the invention, it is now only approx. 0.05% of the good tobacco that is removed in total.

Preferably, the second stream freed from foreign bodies is added to the first tobacco stream upstream of the first foreign body detection device. This means that the second stream, which is then composed per se only of tobacco particles that can be further processed, can be fed back or is fed back to the first tobacco stream. This feedback can take place, for example, on a conveyor trough, for example, a shaking trough, or in the region of a supply gate or in the region of the first stream conveyed by an air flow. This feedback preferably takes place upstream of the first foreign body detection device, but can also take place downstream of the first foreign body detection device and the first foreign body ejection device.

It is particularly preferred for the second stream freed from foreign bodies to be conveyed on a feed device, which mechanically conveys a first tobacco stream and subsequently delivers it into the air flow.

Preferably, the acceleration of the second stream, in particular upstream of the second foreign body detection device, is rendered possible by a reduction in volume of a evacuation channel for the second stream. The tapering of the evacuation channel thus takes place in the conveying direction of the second stream. The Bernouille effect is used hereby. The foreign bodies and tobacco particles ejected or separated from the first tobacco stream are thus entrained by volume reduction or cross-sectional surface reduction of the evacuation channel in the conveying direction and thus the acceleration of the particles.

Preferably, the conveyor speed of the first tobacco stream is controlled or regulated in the region of the first foreign body detection device. Very high foreign body removal rates can be achieved hereby and accordingly a very exact or precise separation of foreign bodies.

Further, the invention is directed to a device for removing foreign bodies from a first tobacco stream with a device (feed device) feeding the first tobacco stream to a first foreign body detection device and a foreign body ejection device downstream of the first foreign body detection device, wherein the feed device for conveying the first tobacco stream comprises a compressed air source and wherein the first foreign body ejection device comprises a first nozzle device, by means of which the foreign bodies can be removed from the first tobacco stream by compressed air, whereby a second stream of foreign bodies and tobacco particles entrained by the compressed air is formed, which is further developed in that a evacuation channel is provided through which the second stream can be guided, wherein the evacuation channel is embodied in a tapering manner at least in some sections in the conveying direction and/or a second foreign body detection device and a second foreign body ejection device is provided downstream of the second foreign body detection device, which has a second nozzle device, by means of which foreign bodies can be removed from the second stream.

Preferably, the evacuation channel is embodied directly adjacent to the feed device in a tapering manner. The adjacent evacuation channel or branching channel, which branches off from the conveying channel or conveying duct, is thus preferably embodied in a tapering manner immediately afterwards. This channel can then be embodied in the flow direction also in a widened manner again later or it can be embodied in a widening manner or with constant volume or constant cross-sectional surface. At first, however, it is essential for the invention for a major part of the invention that the adjoining channel or evacuation channel is tapered or tapers, in order to thus be able to utilize the Bernouille effect for the ejected foreign bodies and tobacco particles.

Preferably, the evacuation channel, which is directly adjacent to the feed device, is a chamber in which a flow body is arranged. By providing the flow body in the chamber it is namely also possible to embody the directly adjacent evacuation channel into which the foreign bodies and the entrained tobacco particles are spun, in a tapering manner in the conveying direction. With the walls of this chamber, the flow body namely forms a channel tapering at least initially in the conveying direction. Preferably, an extension of the flow body downstream of the flow body is provided in order to prevent a return flow.

Preferably, the evacuation channel in which the second stream, in particular freed from foreign bodies, can be conveyed, opens in or upstream of a device conveying a first tobacco stream. A type of circulation of the tobacco particles that are already freed from foreign bodies per se can thereby take place, so that the tobacco particles entrained by the first foreign body removal, which otherwise would be lost or would have to be screened again in a complex manner on conveyor belts as in the prior art, can be added directly to the first tobacco stream again. This can take place before the conveyance with conveying air, directly into the conveying air, namely before the first foreign body detection device or into the conveying stream after the first foreign body detection device.

The measure is particularly preferred in which a control or regulation device is provided which controls or regulates the conveyor speed of the first tobacco stream in the region of the first foreign body detection device. A very precise and efficient removal of foreign bodies is possible hereby. Preferably, one control or regulation input parameter is the frequency or speed of a fan to generate the compressed air or the conveying air flow.

The conveying air flow can preferably be generated by compressed air or suction air and in particular preferably by a combination thereof.

BRIEF DESCRIPTION OF THE DRAWINGS

The invention is described below without restriction of the general inventive concept based on exemplary embodiments with reference to the drawings, wherein reference is expressly made to the drawings with respect to all of the details of the invention not explained in further detail in the text. They show.

DETAILED DESCRIPTION OF THE EMBODIMENTS OF THE INVENTION

In the following figures the same or same type of elements or corresponding parts are provided with the same reference numbers in each case so that a corresponding repeated presentation has been omitted.

Figure 1:
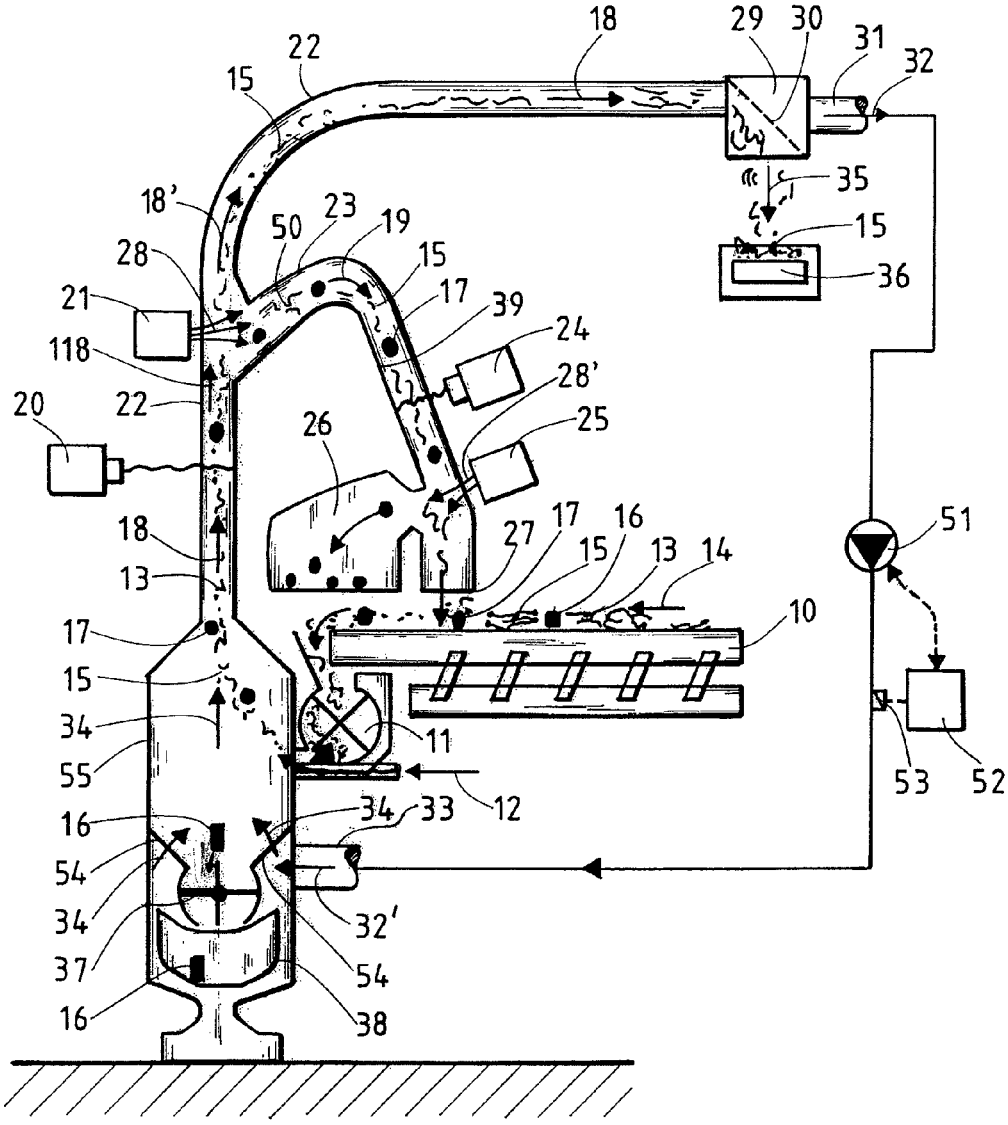
FIG. 1 illustrates a foreign body removal device according to the invention in diagrammatic representation.

FIG. 1 shows diagrammatically a foreign body removal device according to the invention. Firstly a first tobacco stream 13 is transported on a shaking trough 10 in the conveying direction 14. The first tobacco stream 13 contains tobacco particles 15, foreign bodies 17 and heavy contaminants 16, which are also to be considered as foreign bodies. On the left at the end of the shaking trough 10 there is a drop duct, which is reached by the first tobacco stream 13. The first tobacco stream 13 is thus conveyed into a feed gate 11, which can be used for metering the first tobacco stream 13. This conveys the first tobacco stream 13 into a chamber in which a conveying air flow prevails. The conveying air flow is produced among other things by a compressed air flow 32', which is generated by a fan 51 and is introduced through a feed pipe 33, shown diagrammatically, into a corresponding housing 55 and through screens 54 reaches the conveyor chamber as a conveying air flow 34. A further portion of the conveying air flow 34 has its origin in a supply of fresh air 12 and the suction action of the discharged air 32.

In the lower region of the housing 55 a gate 37 is located which takes up heavy contaminants 16 falling downwards and deposits them in a heavy contaminants container 38. The lighter parts, namely the tobacco particles 15 provided for further processing as well as foreign bodies 17, which can be feathers, for example, or tobacco particles not to be used for further processing or, for example, a piece of aluminum foil, are carried vertically upwards through the conveying air flow 34 into the conveying duct 22. A certain portion of fresh air is added via the fresh air supply 12 into the housing 55 via the lower region of the feed gate 11 to the air flow 32' introduced by the fan, which changes into the conveying air flows 34.

The first tobacco stream 13, from which the heavy contaminants 16 have fallen out due to their weight, is now conveyed by means of the conveying air flow 34 in the conveying direction 18 into the region of a first foreign body detection device, which is shown here as a first camera 20, in the conveying duct 22. When the first camera 20 now detects a foreign body 17, the first nozzle device 21 is activated at precisely that moment, which is calculated with a known conveyor speed from the time offset from the region of the foreign body detection to the region of the foreign body removal in the region of the first nozzle device 21. At the correct time a jet of compressed air 28 for eliminating the foreign bodies 17 is produced to the right in the evacuation duct 23.

It should be taken into account hereby that the conveyor duct 22 has a depth that is perpendicular to the sheet plane of FIG. 1 that depends on the conveyor quantity. The depth can be 60 cm, 120 cm or 180 cm, for example, accordingly for 3 tons of tobacco material per hour, 6 tons of tobacco material per hour or 9 tons of tobacco material per hour, respectively. The first camera is accordingly preferably a linear camera with a corresponding depth. The first nozzle device 21 is accordingly also a nozzle device that has several nozzles in the depth, for example, one nozzle every 2 mm, so that only a few nozzles have to be activated to produce a jet of compressed air for each foreign body 17 detected.

If, for example, a foreign body is detected by the first camera 20 at a depth of 20 cm, calculated from the front wall of the conveyor duct 22, for example, eight nozzles, which are arranged approx. 19 cm to 21 cm in the depth can be activated in order to remove the foreign bodies reliably. Naturally, tobacco particles 15 that can be used per se for further processing, are also removed from the first tobacco stream hereby and evacuated into the evacuation duct 23.

The second stream 15 of tobacco particles 15 suitable for further use and foreign bodies 17 thus formed is discharged in the evacuation direction 19 and initially accelerated through the tapering of the evacuation duct 23. The tapering of the evacuation duct 23 is provided minimally or not at all in FIG. 1. The tapering that is preferably provided is accordingly shown better in the further figures.

The tobacco particles 15 and the foreign bodies 17 then reach a corrugated sheet 39, for example, and there slide downwards on the corrugated sheet 39 into the region of a second foreign body detection device in the form of a second camera 24, which can also be a corresponding linear camera with a corresponding depth. If the second camera 24 detects a foreign body 17, accordingly a second nozzle device 25 is also activated again in order to convey the foreign bodies 17 into a foreign body container 26. The remaining tobacco particles reach the first tobacco stream 13 in the conveying direction 27, which tobacco stream is located in the shaking trough 10. This tobacco is then guided back to the further manufacturing process.

The tobacco particles that are not removed or evacuated are conveyed further downstream of the first nozzle device 21 in the conveyor direction 18' in the conveyor duct 22 to an air separator 29, in which the conveying air is separated from the tobacco particles 15 through a screen 30. The conveying air is then guided back via an evacuation pipe 31 to the fan 51. Some conveying air can also hereby be lost in the direction of the tobacco stream 35. For this reason, some additional air, namely fresh air 12, is always added. The tobacco stream 35 then reaches, for example, a conveyor belt 36 and can be further processed, for example, delivered to cigarette production.

In order to control or to regulate the conveyor speed of the first tobacco stream 13 in the conveying direction 18 in the region of the first camera 20, a control or regulation device 52 is provided, which controls or regulates the conveyor speed of the tobacco stream for example via the frequency or the speed of the fan. Alternatively, the speed can also be controlled or regulated via a pressure measurement by a pressure sensor 53 in the tobacco-free air flow in the feed pipe 30 or in the discharge pipe 31. It is also possible that a part of the conveying air is extracted from the evacuation pipe 31 for regeneration, for example, for cooling. For example, conveying air quantities of approx. 24,000 $m^3/h$ are provided in the container 55 and in the conveyor duct 22.

Figure 2:
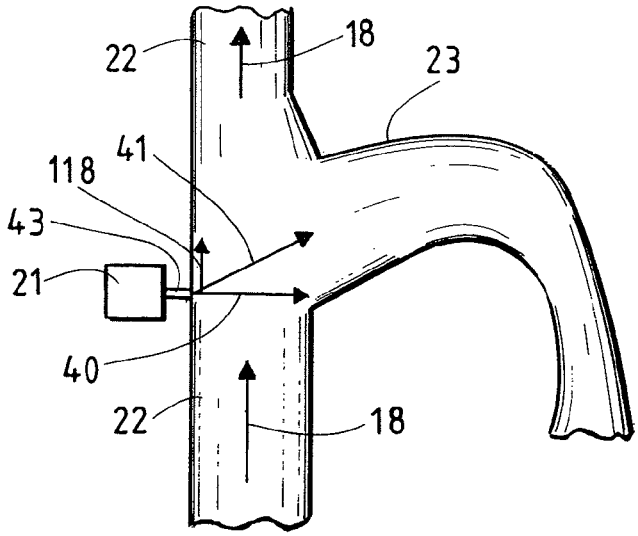
FIG. 2 illustrates a part of the device from FIG. 1 in a first embodiment in diagrammatic representation.

FIG. 2 shows an alternative embodiment of a part of the device according to the invention, namely the part in which the foreign body removal from the first tobacco stream 13 in the region of the first nozzle device 21 takes place. It can be discerned hereby that the first nozzle device 21 has a nozzle strip 43 with several nozzles, which respectively produce a corresponding pressure surge 40. Through the conveying or the conveyor speed 118, which is shown, for example, in FIG. 2 accordingly by an arrow, a resulting stream 41 is produced or a stream with an added-together speed of conveyor speed 118 and pressure surge speed of evacuated particles, namely foreign bodies 17 and entrained tobacco particles 15. These reach the discharge duct 23, which is embodied directly adjoining the conveyor duct 22 in a tapering manner.

In this exemplary embodiment (FIG. 2), the conveyor duct 22 is provided upstream of the first nozzle device with a larger volume or a larger cross-sectional surface than downstream of the evacuation duct 23, whereby an increase in the speed downstream of the discharge duct is produced. Furthermore, it is discernible that the second stream, which is guided through the evacuation duct 23, initially is accelerated in order subsequently to be conveyed again in a region of the evacuation duct 23, which widens again so that a reduction in speed per se is given again. The evacuation duct 23, however, can be embodied such that in fact after an acceleration a constant speed prevails there, since gravity also causes an acceleration in addition to conveyance with compressed air. A correspondingly provided constant speed is in particular advantageous in the region between the second camera and the second nozzle device, which, however, is not shown in FIG. 2.

Figure 3:
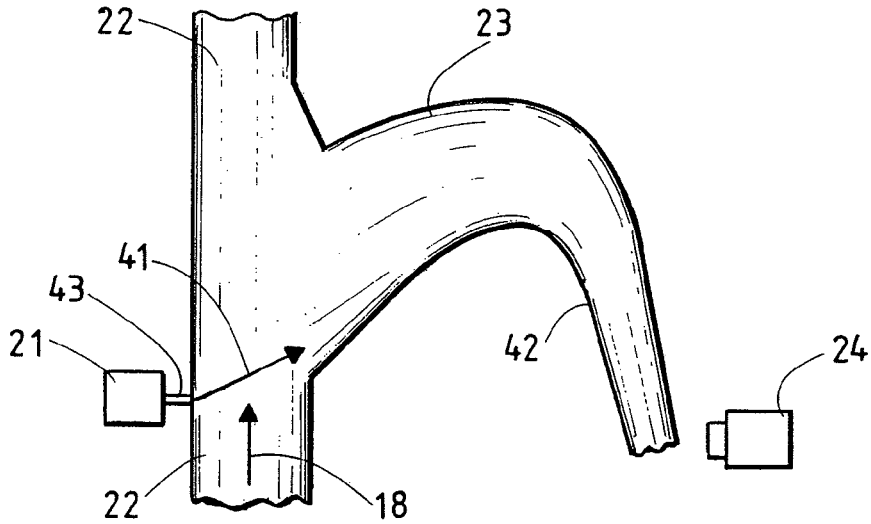
FIG. 3 illustrates a part of FIG. 1 in a second embodiment in diagrammatic representation and FIG. 4 illustrates a part of the device of FIG. 1 in a third embodiment in diagrammatic representation.

In FIG. 3, alternatively to FIG. 2, a free fall of the second stream is not provided, but a sliding of the second stream on a channeled sheet 42, which naturally provides corresponding paths in the conveying direction through the channeling for the second stream. Instead of a channeled sheet 42, a corrugated sheet 39, as in FIG. 1, can also be provided or a smooth sheet. It is discernible in particular that in this exemplary embodiment the evacuation duct 23 is embodied in a tapering manner at least up to the second camera 24.

Figure 4:
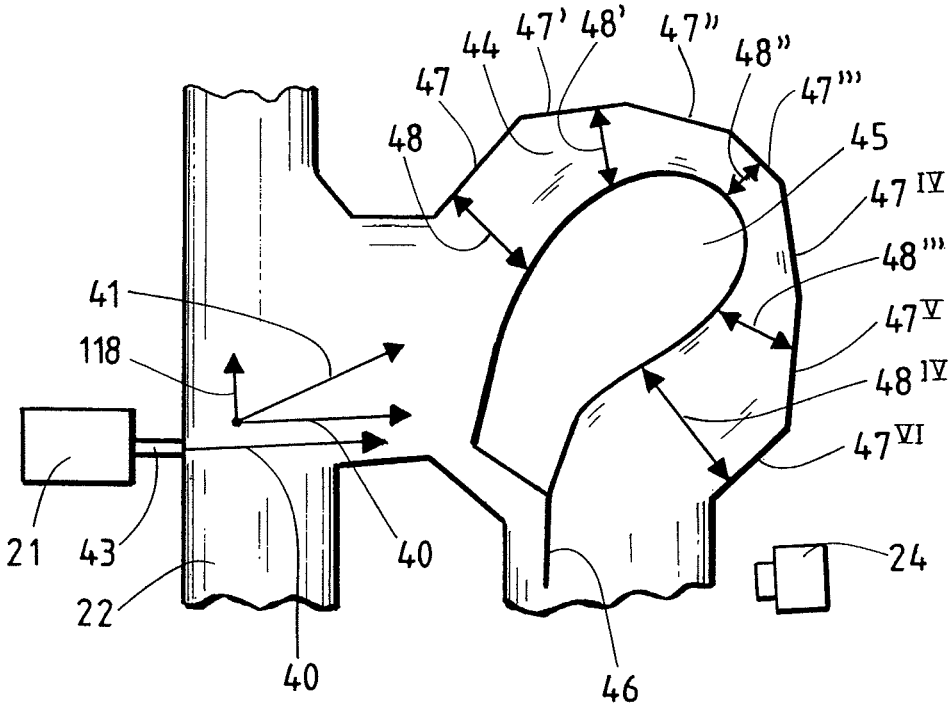

FIG. 4 shows an alternative embodiment in which, instead of a simply embodied evacuation duct 23, a chamber 44 is provided in which a flow body 45 is provided, which in connection with the wall sections 47 through 47$^{VI}$ forms a corresponding evacuation channel. The evacuation channel forming in the conveying direction of the second stream is embodied in a tapering manner here too, namely at a steadily reducing distance of the flow body 45 from the corresponding wall 47 through 47''', so that the distance is steadily reduced accordingly from 48 to 48''. Subsequently, the evacuation duct 23 widens again accordingly, as is shown by the distances 48''' and 48''''. The wall sections 47, 47', 47'', 47''', 47$^{IV}$, 47$^{V}$ and 47$^{VI}$ arranged against one another can also be embodied without edges to one another and thus curved accordingly.

In order to prevent a return flow, an extension 46 of the flow body 45 is also provided.

The shaking trough 10 is used to provide a good and uniform pre-distribution of the first tobacco stream, namely to a desired width or depth, depending on which variant of the foreign body removal device according to the invention is provided, namely, for example, for 3 tons of tobacco material to be conveyed and sorted per hour to 60 cm, with 6 t/h to 120 cm and 9 t/h to 180 cm. Preferably, corresponding devices with a depth of 50 cm to 3 m are provided.

Through the invention it is no longer necessary, as it is necessary in the prior art, to use belt sorters. Magnets are no longer necessary either, since the heavy contaminants, which are usually magnetic, can be removed automatically from the tobacco stream by the force of gravity.

For the material eliminated by the first nozzle device a streamlined channel is preferably provided which ensures that all of the separated material is actually evacuated and does not reach the first tobacco stream again. Preferably, the air in the evacuation channel 23 or 47 is additionally evacuated or suctioned. Preferably, a plurality of neighboring nozzles of the first or second nozzle device are activated in order to reliably separate or eject foreign bodies from the respective stream.

Through the device according to the invention and the method according to the invention a very good removal of foreign bodies with low loss of tobacco can be achieved with very high processing rates. The tobacco loss is improved by more than one order of magnitude compared to the prior art.

All of the referenced features, including those shown by the drawings alone, as well as individual features that are disclosed in combination with other features, are deemed to be essential for the invention alone and in combination. Embodiments according to the invention can be fulfilled by individual features or a combination of several features.

LIST OF REFERENCE NUMBERS

| | |
|---|---|
| 10 | Shaking trough |
| 11 | Feed gate |
| 12 | Fresh air supply |
| 13 | First tobacco stream |
| 14 | Conveying direction |
| 15 | Tobacco particles |
| 16 | Heavy contaminants |
| 17 | Foreign bodies |
| 18, 18' | Conveying direction |
| 19 | Discharge direction |
| 20 | First camera |
| 21 | First nozzle device |
| 22 | Conveyor duct |
| 23 | Evacuation duct |
| 24 | Second camera |
| 25 | Second nozzle device |
| 26 | Foreign body container |
| 27 | Feed direction |
| 28, 28' | Jet of compressed air |
| 29 | Air separator |
| 30 | Screen |
| 31 | Discharge pipe |
| 32, 32' | Conveying air flow |
| 33 | Feed pipe |
| 34 | Conveying air |
| 35 | Tobacco stream |
| 36 | Conveyor belt |
| 37 | Gate |
| 38 | Heavy contaminant container |
| 39 | Corrugated sheet |
| 40 | Pressure surge |
| 41 | Resulting stream |
| 42 | Channeled sheet |
| 43 | Nozzle strip |
| 44 | Evacuation chamber |
| 45 | Flow body |
| 46 | Extension |
| 47, 47', 47'', 47''' 47$^{IV}$, 47$^{V}$, 47$^{VI}$ | Wall section |
| 48, 48', 48'', 48''', 48$^{IV}$ | Distance |
| 50 | Second stream |
| 51 | Fan |
| 53 | Regulating device |
| 53 | Pressure sensor |
| 54 | Regulating device |
| 55 | Housing |
| 118 | Conveyor speed |

The invention claimed is:

1. A method for removing foreign bodies from a first tobacco stream that is conveyed via an air flow in a region of a first foreign body detection device, comprising:

detecting, with a first foreign body detection device, the foreign bodies in the first tobacco stream based on at least one property;

removing, with a jet of compressed air, the foreign bodies from the first tobacco stream, whereby a foreign body freed tobacco stream and a second tobacco stream comprising tobacco particles and the foreign bodies entrained by the jet of compressed air are formed;

accelerating the second stream at a distance from the first tobacco stream through tapering channel; and detecting, with a second foreign body detector, foreign bodies in the second stream based on at least one property and removing the detected foreign bodies with a second jet of compressed air.

2. The method in accordance with claim 1, further comprising adding the second tobacco stream, after the detected foreign bodies in the second stream have been removed, to the first tobacco stream at a location upstream of the first foreign body detection device.

3. The method in accordance with claim 1, wherein the second stream is accelerated by a reduction in volume in a discharge evacuation channel for the second stream.

4. The method in accordance with claim 3, wherein the second stream is accelerated upstream of the second foreign body detection device.

5. The method in accordance with claim 1, further comprising controlling or regulating a conveyor speed of the first tobacco stream in the region of the first foreign body detection device.

6. A device for removing foreign bodies from a first tobacco stream, comprising:

a first foreign body detection device;

a feed device structured and arranged to feed the first tobacco stream to the first foreign body detection device via a compressed air source;

a first foreign body ejection device located downstream of the first foreign body detection device and having a first nozzle device structured and arranged to remove foreign bodies from the first tobacco stream with compressed air;

an evacuation channel being structured and arranged to guide a second stream formed by tobacco particles and the foreign bodies entrained by the compressed air of the first foreign body ejection device and having a tapering portion in which the second stream is accelerated; and a second foreign body detection device and a second foreign body ejection device located downstream of the second foreign body detection device, the second foreign body ejection device having a second nozzle device structured and arranged to remove the foreign bodies from the second stream.

7. The device in accordance with claim 6, wherein the evacuation channel directly adjacent to the feed device is formed in a tapering manner.

8. The device in accordance with claim 6, wherein the evacuation channel directly adjacent to the feed device is formed as a chamber in which a flow body is arranged.

9. The device in accordance with claim 6, wherein the evacuation channel opens one of in or upstream of the feed device.

10. The device in accordance with claim 6, further comprising a control or regulation device structured and arranged to control or regulate a conveyor speed of the first tobacco stream in a region of the first foreign body detection device.

11. The device in accordance with claim 10, wherein the control or regulation device receives control input parameters including a frequency of a fan generating the conveying air flow.

* * * * *